US011295650B2

(12) United States Patent
Kim et al.

(10) Patent No.: US 11,295,650 B2
(45) Date of Patent: Apr. 5, 2022

(54) DISPLAY DRIVING DEVICE AND DISPLAY DEVICE INCLUDING THE SAME

(71) Applicant: Silicon Works Co., Ltd., Daejeon (KR)

(72) Inventors: Myung Yu Kim, Daejeon (KR); Do Seok Kim, Daejeon (KR); Hyun Pyo Cho, Daejeon (KR); Yong Hwan Moon, Daejeon (KR)

(73) Assignee: Silicon Works Co., Ltd, Daejeon (KR)

( * ) Notice: Subject to any disclaimer, the term of this patent is extended or adjusted under 35 U.S.C. 154(b) by 0 days.

(21) Appl. No.: 16/925,302

(22) Filed: Jul. 9, 2020

(65) Prior Publication Data

US 2021/0193005 A1 Jun. 24, 2021

(30) Foreign Application Priority Data

Dec. 24, 2019 (KR) ..... 10-2019-0174234

(51) Int. Cl.
*G09G 3/20* (2006.01)

(52) U.S. Cl.
CPC ..... *G09G 3/20* (2013.01); *G09G 2310/0275* (2013.01); *G09G 2310/08* (2013.01); *G09G 2370/08* (2013.01)

(58) Field of Classification Search
CPC ..... G06F 3/011; G06F 3/147; G06F 3/012; G09G 5/38; G09G 2340/0464; G09G 2354/00; G09G 3/003; G09G 3/20; G09G 2310/0275; G09G 2310/08; G09G 2370/08; G09G 2330/06; G09G 5/008; G09G 3/2092; G09G 2310/0264; G09G 2310/06; G09G 2370/10; G06T 19/00; G02B 27/02
See application file for complete search history.

(56) References Cited

U.S. PATENT DOCUMENTS

| | | | | |
|---|---|---|---|---|
| 11,004,423 | B2 * | 5/2021 | Tzeng | G09G 5/008 |
| 11,127,327 | B2 * | 9/2021 | Kim | G09G 3/20 |
| 2007/0069214 | A1 * | 3/2007 | Lee | G09G 3/3648 257/72 |
| 2013/0076703 | A1 * | 3/2013 | Baek | G09G 3/2092 345/204 |
| 2014/0269954 | A1 | 9/2014 | Whitby-Strevens | |
| 2015/0187315 | A1 * | 7/2015 | Park | G09G 5/008 345/99 |

(Continued)

FOREIGN PATENT DOCUMENTS

| | | | |
|---|---|---|---|
| KR | 20100081933 | B1 | 7/2010 |
| KR | 20160086949 | B1 | 7/2016 |
| KR | 20190077909 | A | 7/2019 |

*Primary Examiner* — Grant Sitta
(74) *Attorney, Agent, or Firm* — Polsinelli PC

(57) ABSTRACT

The present disclosure discloses a display driving device and a display device including the same, which enable the influence of high voltage noise to be avoided in display panel driving. The display device includes a timing controller configured to transmit a communication signal, which includes a blank pattern and line data, at a horizontal line interval, and a source driver configured to restore the blank pattern and the line data in the communication signal and drive a display panel using the blank pattern and the line data. The timing controller may include a configuration packet in the blank pattern and position the configuration packet in an end period of the blank pattern.

14 Claims, 6 Drawing Sheets

(56) References Cited

U.S. PATENT DOCUMENTS

| | | | | |
|---|---|---|---|---|
| 2016/0125840 | A1* | 5/2016 | Oh | G09G 5/008 345/213 |
| 2016/0164705 | A1* | 6/2016 | Whitby-Strevens | G09G 5/006 375/259 |
| 2020/0184877 | A1* | 6/2020 | Pyun | G09G 3/3688 |
| 2021/0150976 | A1* | 5/2021 | Wei | G09G 3/2085 |

* cited by examiner

DISPLAY DRIVING DEVICE AND DISPLAY DEVICE INCLUDING THE SAME

CROSS-REFERENCE TO RELATED APPLICATION

This application claims priority to and the benefit of Korean Patent Application No. 2019-0174234, filed on Dec. 24, 2019, the disclosure of which is incorporated herein by reference in its entirety.

BACKGROUND

Field of the Invention

The present disclosure relates to a display device, and more particularly, to a display driving device and a display device including the same, which enable the influence of high voltage noise to be avoided in display panel driving.

Discussion of Related Art

Generally, display devices include a display panel, a source driver, a timing controller, and the like.

The source driver converts digital image data provided from the timing controller into a data voltage and provides the data voltage to the display panel. The source driver may be integrated into an integrated circuit chip (IC chip) and may be configured as a plurality of IC chips in consideration of the size and resolution of the display panel.

Meanwhile, the source driver drives horizontal lines of the display panel each frame time to display an image. When the source driver drives the display panel at horizontal line intervals, high voltage noise may be generated periodically.

The high voltage noise may affect a low-voltage-range circuit to induce an abnormal operation and may affect low-voltage input data input during horizontal blank periods to possibly affect the display panel driving.

As an example, the related art has a problem in that when a packet such as a scramble reset signal is affected by high voltage noise, an important control data packet may not be normally received and thus the display panel may not be normally driven.

SUMMARY OF THE INVENTION

The present disclosure is directed to providing a display driving device and a display device including the same, which enable the influence of high voltage noise to be avoided in display panel driving.

According to an aspect of the present disclosure, there is provided a display device including a timing controller configured to transmit a communication signal, which includes a blank pattern and line data, at a horizontal line interval, and a source driver configured to restore the blank pattern and the line data in the communication signal and drive a display panel using the blank pattern and the line data. The timing controller may include a configuration packet in the blank pattern and position the configuration packet in an end period of the blank pattern.

According to another aspect of the present disclosure, there is provided a display driving device including at least one source driver configured to restore a blank pattern and line data in a communication signal transmitted at a horizontal line interval and drive a display panel using the blank pattern and the line data. A configuration packet may be included in the blank pattern, and the configuration packet may be set to be positioned in an end period of the blank pattern.

BRIEF DESCRIPTION OF THE DRAWINGS

The above and other objects, features, and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Embodiments disclose a display driving device and a display device including the same, which enable the influence of high voltage noise to be avoided in display panel driving.

Embodiments disclose a display driving device and a display device including the same, which enable an electromagnetic interference (EMI) reduction effect to be improved by converting transmission data into a completely random code sequence.

Embodiments disclose a display driving device and a display device including the same, which allow the time for a configuration mode operating at a low frequency to be reduced by defining the length of a data packet, which is variable, in a header to support high-speed data communication.

Embodiments disclose a display driving device and a display device including the same, which enable a communication abnormal state to be restored to a normal state when a communication abnormality occurs due to an unexpected variable during communication between a timing controller and source drivers.

In embodiments, a restoration protocol or a recovery mode may be defined as a protocol or a mode that makes the communication states between a timing controller and source drivers in the same state.

In embodiments, a configuration protocol, a configuration mode, or a configuration period may be defined as a protocol, a mode, or a period for setting an option of Internet Protocol (IP) of communication links operating at high speed in a display mode, an option of a clock data recovery circuit of a source driver, an option for pre-clock training, and an equalizer option.

In embodiments, a display mode or a display period may be defined as a mode or a period for processing configuration data and image data of a source driver.

In embodiments, pre-clock training or a bandwidth setting period may be defined as a mode or a period for searching for and setting an optimal frequency bandwidth of communication links operating at high speed in a display mode.

In embodiments, equalizer training or an equalizer period may be defined as a mode or a period for setting an equalizer gain level to improve the characteristics of communication links operating at high speed in a display mode.

In embodiments, a scrambling protocol may be defined as a promised protocol between a timing controller and source drivers, in which the timing controller scrambles transmission data in a random code sequence and transmits the random code sequence to the source driver, and the source driver restores the transmission data by descrambling the random code sequence.

In embodiments, a configuration of a horizontal blank period may include a scramble reset.

In embodiments, terms "first," "second," and the like may be used for the purpose of distinguishing a plurality of elements from one another. Here, the terms "first," "second," and the like are not intended to limit the elements.

Figure 1:
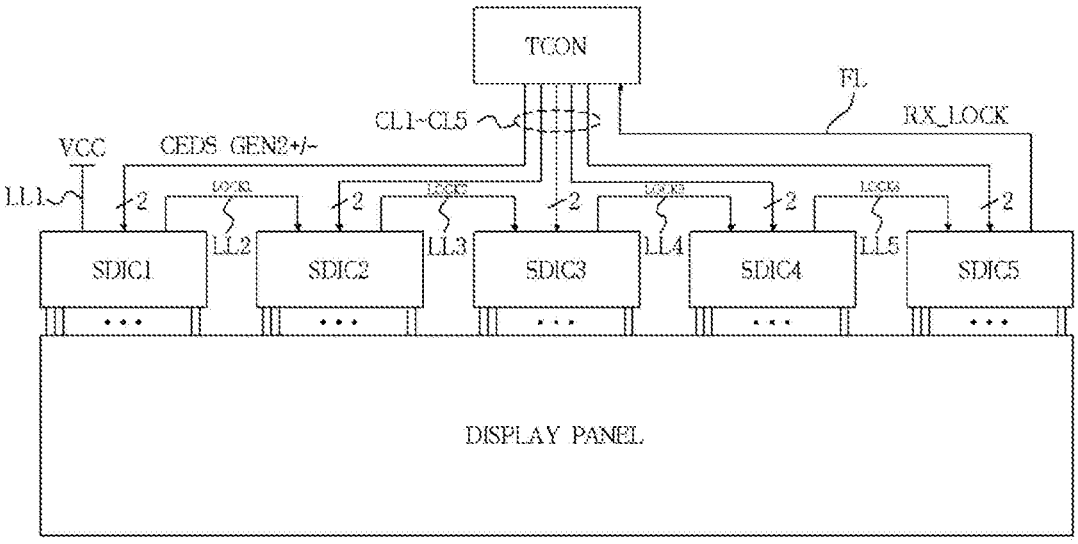
FIG. 1 is a block diagram of a display device according to one embodiment.

FIG. 1 is a block diagram of a display device according to one embodiment.

Referring to FIG. 1, the display device may include a timing controller TCON, a plurality of first to fifth source drivers SDIC1 to SDIC5, and a display panel.

The timing controller TCON may be connected to the plurality of first to fifth source drivers SDIC1 to SDIC5 through first to fifth communication links CL1 to CL5 in a point-to-point manner.

As an example, the timing controller TCON may be connected to the first source driver SDIC1 through the first communication link CL1, and the timing controller TCON may be connected to the second source driver SDIC2 through the second communication link CL2. The timing controller TCON may be connected to the third source driver SDIC3 through the third communication link CL3, and the timing controller TCON may be connected to the fourth source driver SDIC4 through the fourth communication link CL4. The timing controller TCON may be connected to the fifth source driver SDIC5 through the fifth communication link CL5. In addition, each of the first to fifth communication links CL1 to CL5 may be configured as a pair of differential signal lanes.

The timing controller TCON may provide a communication signal CEDS GEN2+/− to the source drivers SDIC1 to SDIC5 through the first to fifth communication links CL1 to CL5, respectively.

In addition, the first to fifth source drivers SDIC1 to SDIC5 may be connected to each other through first to fifth lock links LL1 to LL5 in a cascade manner.

As an example, a power voltage terminal VCC may be connected to the first source driver SDIC1 through the first lock link LL1. The first source driver SDIC1 may be connected to the second source driver SDIC2 through the second lock link LL2, and the second source driver SDIC2 may be connected to the third source driver SDIC3 through the third lock link LL3. The third source driver SDIC3 may be connected to the fourth source driver SDIC4 through the fourth lock link LL4, and the fourth source driver SDIC4 may be connected to the fifth source driver SDIC5 through the fifth lock link LL5. In addition, the fifth source driver SDIC5, which is the last one, may be connected to the timing controller TCON through a feedback link FL.

The first source driver SDIC1 may transmit a first lock signal LOCK1 to the second source driver SDIC2 through the second lock link LL2, and the second source driver SDIC2 may transmit a second lock signal LOCK2 to the third source driver SDIC3 through the third lock link LL3. The third source driver SDIC3 may transmit a third lock signal LOCK3 to the fourth source driver SDIC4 through the fourth lock link LL4, and the fourth source driver SDIC4 may transmit a fourth lock signal LOCK4 to the fifth source driver SDIC5 through the fifth lock link LL5. In addition, the fifth source driver SDIC5 may transmit a fifth lock signal RX_LOCK to the timing controller TCON through the feedback link FL. Here, the fifth lock signal RX_LOCK may indicate a communication state of at least one of the first to fifth source drivers SDIC1 to SDIC5. The fifth lock signal RX_LOCK may be switched to have a value indicating a communication abnormal state when a lock failure occurs in at least one of the first to fifth source drivers SDIC1 to SDIC5.

Figure 2:
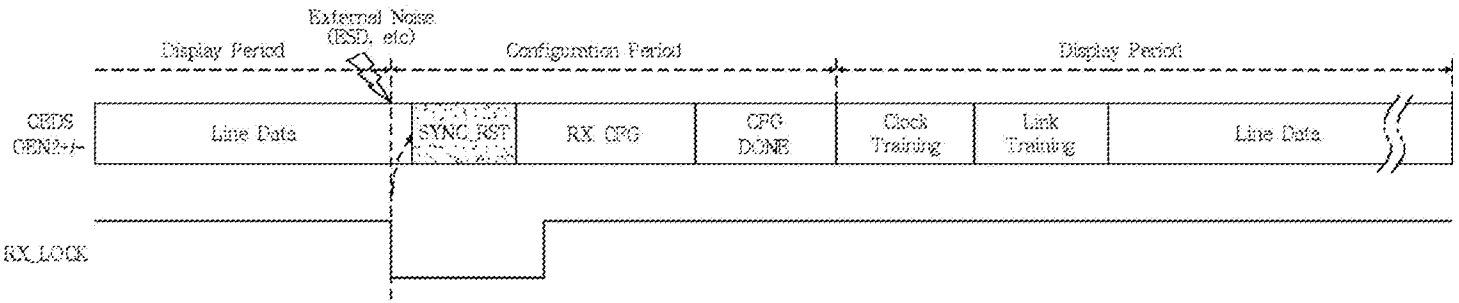
FIG. 2 is a diagram for describing a restoration protocol of the display device according to one embodiment.

FIG. 2 is a diagram for describing a restoration protocol of the display device according to one embodiment.

Referring to FIG. 2, when the communication abnormal state occurs due to external noise such as an electrostatic discharge (ESD) while performing a display mode, the display device may be switched from the display mode to a configuration mode.

As an example, when a lock failure occurs in at least one of the first to fifth source drivers SDIC1 to SDIC5, the fifth source driver SDIC5 may switch the level of the fifth lock signal RX_LOCK from a high level to a low level and provide the fifth lock signal RX_LOCK to the timing controller TCON.

When the lock failure occurs, the timing controller TCON may include a restore command SYNC_RST, for restoring the communication state, in the communication signal CEDS GEN2+/− and transmit the communication signal CEDS GEN2+/− to the first to fifth source drivers SDIC1 to SDIC5 through the first to fifth communication links CL1 to CL5.

As an example, the timing controller TCON may transmit the restore command SYNC_RST having a predetermined level for a predetermined period of time. In addition, the timing controller TCON may transmit a configuration data packet RX CFG to the first to fifth source drivers SDIC1 to SDIC5 after transmitting the restore command SYNC_RST for the predetermined period of time.

The first to fifth source drivers SDIC1 to SDIC5 may receive the restore command SYNC_RST and the configuration data packet RX CFG, and may perform a configuration mode according to the configuration data packet RX CFG. Here, the configuration mode may be defined as a mode for setting an IP option of the first to fifth communication links CL1 to CL5 operating at high speed in the display mode.

In addition, the configuration mode may be set to operate in a low-frequency band compared to the display mode.

In addition, the timing controller TCON may transmit configuration completion data CFG DONE to the first to fifth source drivers SDIC1 to SDIC5 after transmitting the entire configuration data packet RX CFG.

As an example, the timing controller TCON may transmit the configuration completion data CFG DONE, which has a value in which 0 and 1 are continuously toggled for a predetermined period of time, to the first to fifth source drivers SDIC1 to SDIC5.

In addition, when the first to fifth source drivers SDIC1 to SDIC5 receive the configuration completion data CFG DONE from the timing controller TCON, the first to fifth source drivers SDIC1 to SDIC5 may be switched from the configuration mode to the display mode.

The first to fifth source drivers SDIC1 to SDIC5 may restore a phase lock loop (PLL) clock of an internal clock data recovery circuit (not shown) by performing clock training in a display period.

Next, after the clock training in the display period, the first to fifth source drivers SDIC1 to SDIC5 may lock symbol boundary detection and a symbol clock by performing link training.

Next, after the link training in the display period, the first to fifth source drivers SDIC1 to SDIC5 may receive frame data transmitted from the timing controller TCON, convert line data included in the frame data into a data voltage, and provide the data voltage to the display panel.

Figure 3:
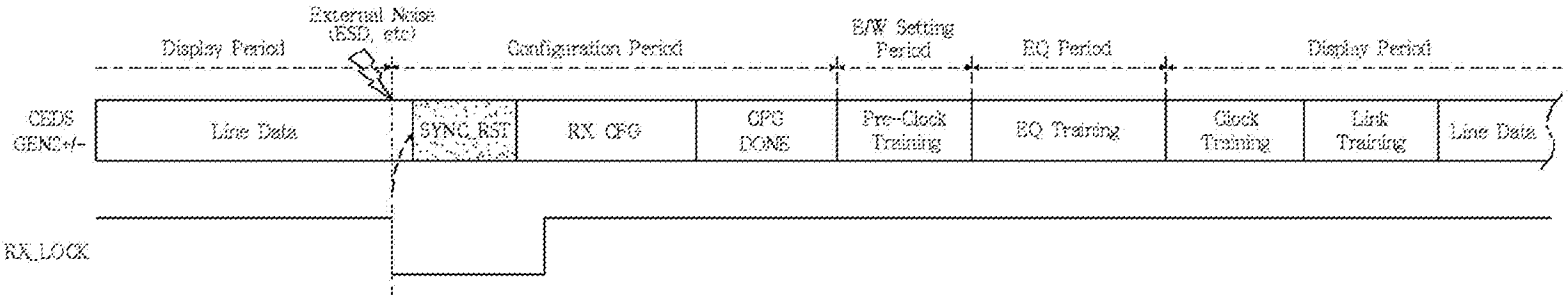
FIG. 3 is a diagram for describing a restoration protocol of a display device according to another embodiment.

FIG. 3 is a diagram for describing a restoration protocol of a display device according to another embodiment. In describing FIG. 3, the description that overlaps that of the embodiment described with reference to FIG. 2 is replaced by the description of FIG. 2.

Referring to FIG. 3, when a communication abnormal state occurs due to external noise, the timing controller TCON may transmit a restore command SYNC_RST having a predetermined level to the first to fifth source drivers SDIC1 to SDIC5 for a predetermined period of time.

Next, after the restore command SYNC_RST is transmitted for the predetermined period of time, the timing controller TCON may transmit a configuration data packet RX CFG to the first to fifth source drivers SDIC1 to SDIC5.

As an example, the timing controller TCON may include a pre-clock training option and an equalizer training option in the configuration data packet RX CFG when transmitting the configuration data packet RX CFG to the first to fifth source drivers SDIC1 to SDIC5.

Next, after a configuration mode is completed, the first to fifth source drivers SDIC1 to SDIC5 may perform pre-clock training to set an optimal frequency bandwidth of the first to fifth communication links CL1 to CL5 operating at high speed in a display mode.

Next, after the pre-clock training is completed, the first to fifth source drivers SDIC1 to SDIC5 may perform equalizer training to set an equalizer gain level in which the characteristics of the communication links operating at high speed in the display mode may be improved.

As an example, the timing controller TCON may repeatedly transmit the pattern of equalizer clock training and equalizer link training during an equalizer period as many times as set in the previous configuration mode.

The first to fifth source drivers SDIC1 to SDIC5 may change the level of the equalizer gain level by a value set in the previous configuration mode.

In addition, each of the first to fifth source drivers SDIC1 to SDIC5 may check locking, symbol locking, and the number of errors of the clock data recovery circuit according to the equalizer gain level thereof.

In addition, the first to fifth source drivers SDIC1 to SDIC5 may compare locking, symbol locking, and the number of errors of the clock data recovery circuit according to the equalizer gain level to select the most effective equalizer gain level, and set the first to fifth communication links CL1 to CL5 accordingly.

Here, the pre-clock training and the equalizer training may be set to operate in a high-frequency band compared to the configuration mode.

In addition, the first to fifth source drivers SDIC1 to SDIC5 may be switched to the display mode after completing the equalizer training.

The first to fifth source drivers SDIC1 to SDIC5 may restore a PLL clock by performing the clock training in the display mode, and may lock symbol boundary detection and a symbol clock by performing the link training.

In addition, the first to fifth source drivers SDIC1 to SDIC5 may convert line data transmitted from the timing controller TCON into a data voltage, and provide the data voltage to the display panel.

As described above, according to the embodiments, when the communication abnormality occurs between the timing controller and the source driver due to unexpected variables, the communication abnormal state may be restored to a normal state at the desired time, thereby preventing a communication failure.

Figure 4:
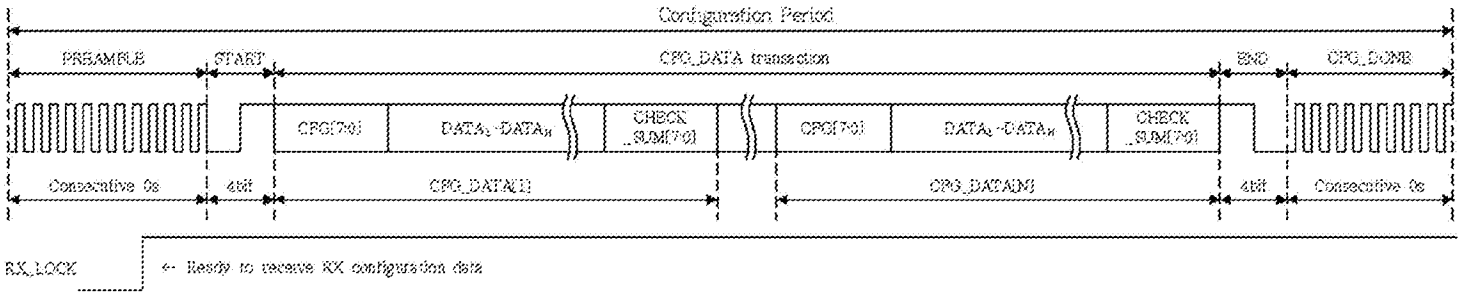
FIG. 4 is a diagram for describing a configuration protocol of the display device according to one embodiment.

FIG. 4 is a diagram for describing a configuration protocol of the display device according to one embodiment. Hereinafter, for convenience of explanation, a case in which communication is performed between the timing controller and one source driver will be described as an example.

Referring to FIG. 4, the source driver may receive a communication signal having a format of preamble data PREAMBLE, start data START, configuration data CFG_DATA, end data END, and configuration completion data CFG_DONE from the timing controller TCON in a configuration mode. The configuration data CFG_DATA may include a header CFG[7:0] that defines the length of data packets $DATA_1$ to $DATA_N$.

The configuration data CFG_DATA may have a format of the header CFG[7:0], the data packets $DATA_1$ to $DATA_N$, and a checksum CHECK_SUM[7:0].

The header CFG[7:0] may define the number of bytes of the data packets $DATA_1$ to $DATA_N$ of the current transaction. In addition, the header CFG[7:0] may define the total number of sequences CFG_DATA[1] to CFG_DATA[N] of the configuration data CFG_DATA. In addition, the header CFG[7:0] may define whether the checksum CHECK_SUM [7:0] is activated.

As an example, the header CFG[7:0] may be composed of 8 bits, and a [0] bit of the header CFG[7:0] may be used for synchronization, [3:1] bits of the header CFG[7:0] may be used to define the number of bytes of the data packets $DATA_1$ to $DATA_N$ of the current transaction, [6:4] bits of the header CFG[7:0] may be used to define the total number of the sequences CFG_DATA[1] to CFG_DATA[N] of the configuration data CFG_DATA. In addition, a [7] bit of the header CFG[7:0] may define whether the checksum CHECK_SUM[7:0] is activated.

First, the source driver may receive the preamble data PREAMBLE, which is continuously toggled between levels of 0 and 1, in the configuration mode.

Next, when the source driver continuously receives the preamble data PREAMBLE for a predetermined period of time, the source driver may transmit a lock signal RX_LOCK indicating that the source driver is ready to receive the configuration data CFG_DATA to the timing controller TCON. As an example, the source driver may provide the lock signal RX_LOCK by switching from a low level to a high level.

Next, the timing controller TCON may transmit the start data START, the configuration data CFG_DATA, the end data END, and the configuration completion data CFG_DONE to the source driver in response to the lock signal RX_LOCK. Here, the start data START may be set to a level of "0011," and the end data END may be set to a level of "1100."

Next, after the end data END of "1100" is received, the source driver may receive the configuration completion data CFG_DONE continuously toggled between levels of 0 and 1.

Next, when the source driver receives the configuration completion data CFG_DONE for a predetermined period of time, the source driver may perform pre-clock training, equalizer training, or a display mode according to the configuration data CFG_DATA.

Figure 5:
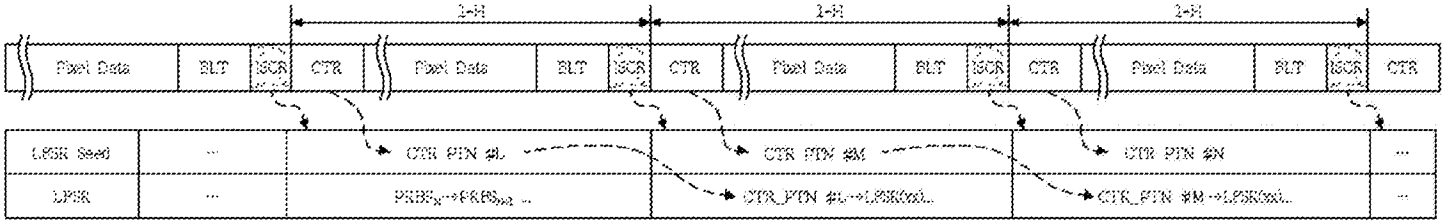
FIG. 5 is a diagram for describing a scrambling protocol of the display device according to one embodiment.

FIG. 5 is a diagram for describing a scrambling protocol of the display device according to one embodiment.

The timing controller TCON may scramble transmission data into a pseudo-random binary sequence (PRBS) using a linear feedback shift register (LFSR), and the timing controller TCON may include the PRBS in a communication signal and transmit the communication signal to the source driver SDIC. The transmission data may include at least one of a control data packet, image data, and a data checksum.

As an example, the timing controller TCON may include a scrambler (not shown) for scrambling the transmission data. The scrambling is the process of mixing every bit of the transmission data to be transmitted, and may prevent the same bit, for example, 1 or 0, from being continuously placed over K (here K is a natural number greater than or equal to 2) times in a data transmission stream. The scrambling may be performed according to a previously agreed protocol.

The LFSR is a type of shift register and may have a structure in which a value input to the register is calculated as a linear function of previous state values. As an example, the LFSR may use an exclusive-or (XOR) operation as a linear function. Here, the value of initial bits of the LFSR may be called a seed, and since the operation of the LFSR is deterministic, the sequence of values generated by the LFSR may be determined by the previous value. In addition, since the number of values that the register can have is finite, the sequence may be repeated at a particular period.

The timing controller TCON may periodically change the seed value of the LFSR. As an example, the timing controller TCON may change the seed value at a frame interval or a line interval. In addition, the timing controller TCON may change the seed value using the control data packet. As another example, the timing controller TCON may change the seed value using at least one of the image data and the data checksum.

The timing controller TCON may calculate the value of the transmission data, which is input to the LFSR, and the state values of the previous transmission data by a linear function to scramble the transmission data.

In addition, the timing controller TCON may include the PRBS, which is obtained by scrambling the transmission data, in the communication signal, and may transmit the communication signal to the source driver through the communication link.

The source driver SDIC may receive the communication signal from the timing controller TCON through the communication link, and may descramble the PRBS included in the communication signal to the transmission data. In addition, the source driver SDIC may drive the display panel using the transmission data.

As an example, the source driver SDIC may include a descrambler (not shown) configured to descramble the PRBS to the transmission data. The descrambler may perform a function of restoring the stream, in which each bit is mixed with each other, back to the original data.

The source driver SDIC may receive a scramble reset signal in a blank link training period.

As an example, the source driver SDIC may descramble the PRBS using at least one of a control data packet, image data, and a data checksum transmitted as transmission data of a previous horizontal line when a scramble reset signal ISCR is activated.

As described above, the timing controller TCON may perform the scramble reset at regular intervals, and may change the seed value using at least one of the control data packet, the image data, and the data checksum transmitted as the transmission data every time the scramble reset is performed.

Then, the source driver SDIC may descramble the PRBS using at least one of the control data packet, the image data, and the data checksum transmitted as the previous transmission data.

The timing controller TCON and the source driver SDIC may perform both high-speed data communication and low-speed data communication, and the above-described transmission and reception of the control data packet, the image data, and the data checksum may be performed through the high-speed data communication.

A clock and a link are trained for the high-speed data communication in a display period, and the control data packet, the image data, and the data checksum may be transmitted and received according to the trained clock and link.

In the display mode of the display period, the transmission and reception of the transmission data, which includes the control data packet, the image data, and the data checksum in frame and line units, may be repeated after the clock training and the link training have been performed.

Since the transmission data is transmitted and received through the high-speed data communication in the display mode, the reception rate of data may be changed according to a set value for the communication. In order to increase the reception rate and allow the high-speed data communication to be smoothly performed, the timing controller TCON and the source driver SDIC may transmit and receive information for supporting the high-speed data communication through the low-speed data communication. The description related to this is replaced with the description of FIG. 2.

According to the embodiments described above, an electromagnetic interference (EMI) reduction effect may be improved by converting the transmission data into a completely random code sequence.

In addition, according to the embodiments, it is possible to use a low order polynomial by controlling the seed value in the method of generating the PRBS using the LFSR, so that the size of a source driver chip may be reduced.

Figure 6:
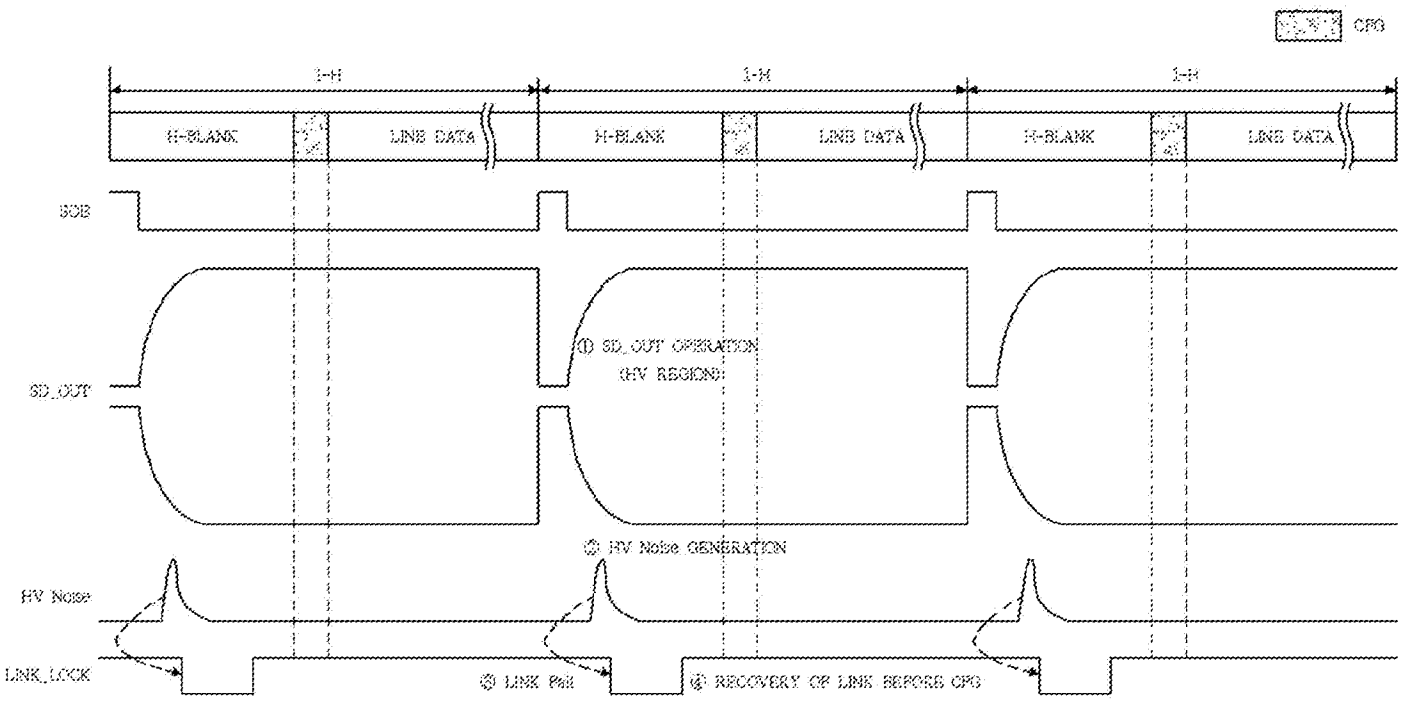
FIG. 6 is a view for describing a protocol for defining the position of a configuration packet of the display device according to one embodiment.

FIG. 6 is a view for describing a protocol for defining the position of a configuration packet of the display device according to one embodiment.

The timing controller TCON may transmit a communication signal including a blank pattern H-BLANK and line data LINE DATA to at least one source driver SDIC at a horizontal line interval 1-H.

The timing controller TCON may include a configuration packet CFG in the blank pattern H-BLANK, and may position the configuration packet CFG in an end period of the blank pattern H-BLANK.

As an example, the timing controller TCON may position the configuration packet CFG in the end period of the blank pattern H-BLANK positioned farthest from line data LINE DATA of a previous horizontal line. The timing controller TCON may include at least one of clock training, link training, and the configuration packet CFG in the blank pattern H-BLANK. In addition, the timing controller TCON may include at least one of a control data packet, image data, and a data checksum in the line data LINE DATA.

As another example, when a failure occurs in a link lock signal LINK_LOCK, the timing controller TCON may include the configuration packet CFG in the end period of the blank pattern H-BLANK, after restoring the link lock signal LINK_LOCK, by enabling a source output enable signal SOE.

The source driver SDIC may restore the blank pattern H-BLANK and the line data in the communication signal, and may drive the display panel using the blank pattern H-BLANK and the line data LINE DATA.

The source driver SDIC may receive the source output enable signal SOE enabled at the horizontal line interval 1-H, and may provide the link lock signal LINK_LOCK, which indicates the lock failure, to the timing controller TCON when the lock failure occurs after the source output enable signal is enabled.

The source driver SDIC may restore the link with the timing controller TCON using at least one of the clock training and the link training included in the blank pattern H-BLANK. As an example, the source driver SDIC may restore a PLL clock by performing the clock training, and lock symbol boundary detection and a symbol clock by performing the link training.

The source driver SDIC may provide the link lock signal LINK_LOCK indicating that the link is restored to the timing controller TCON, and after the link is restored, may receive the configuration packet CFG, which is positioned at the end period of the blank pattern H-BLANK, from the timing controller TCON.

As an example, when the source driver SDIC receives the source output enable signal SOE, the source driver SDIC may perform an operation of outputting a data voltage corresponding to image data to the display panel (①).

Here, the source driver SDIC may simultaneously drive output circuits, each of which corresponds to each channel configured to output the data voltage to numerous data lines of the display panel. The output circuits operate in a high voltage region, and high voltage noise may be generated instantaneously due to the operation of the output circuits operating in the high voltage region (②). The high voltage noise may cause a link failure between the timing controller TCON and the source driver SDIC (③).

The source driver SDIC may restore the link between the timing controller TCON and the source driver SDIC by performing the clock training to restore the PLL clock and performing the link training to lock the symbol boundary detection and the symbol clock (④).

The timing controller TCON may include the configuration packet CFG in the end period of the blank pattern H-BLANK after the link is restored. A scramble reset signal may be included in the configuration packet CFG.

The source driver SDIC may restore at least one of the control data packet, the image data, and the data checksum of the line data LINE DATA in response to the scramble reset signal in the configuration packet CFG.

When a critical packet such as the scramble reset signal is affected by high voltage noise, the source driver SDIC may not properly restore the control data packet so that normal driving may be impossible. However, according to the embodiments, the line data including the control data packet, the image data, and the data checksum are properly restored by changing the protocol such that the configuration packet CFG including the scramble reset signal may be received after the high voltage noise is stabilized, thereby avoiding the influence of high voltage in driving the display panel.

The operation of the display device as described above will be described in detail below.

When the display device is powered on, the timing controller TCON may transmit a clock pattern for clock training to the source driver SDIC. The clock pattern may be transmitted by being included in a communication signal. The source driver SDIC receives the clock pattern and may train a clock thereof according to the clock pattern. In addition, the source driver SDIC may switch the level of a lock signal from a low level to a high level after completing the clock training, and transmit the lock signal to the timing controller TCON through the feedback link FL.

The timing controller TCON and the source driver SDIC may perform communication using a PLL mode, and in this manner, the source driver SDIC may generate an internal clock in accordance with a frequency and a phase of the clock pattern, and may restore the control data packet, the image data, and the data checksum using the internal clock.

In addition, when the link between the timing controller TCON and the source driver SDIC fails, the display device may perform the clock training again. After the clock training is completed, the timing controller TCON may transmit link data through the communication signal.

The source driver SDIC may receive the link data according to a clock thereof and train the link according to the link data. The link training may be performed at an initial stage of data transmission. In addition, when the link between the timing controller TCON and the source driver SDIC fails, the link training may be performed again. After the link training is completed, the timing controller TCON may transmit image data through the communication signal.

The image data may be transmitted for each frame. In addition, there may be a vertical blank period between the image data transmitted for each frame.

One frame period may include a plurality of horizontal line periods 1-H corresponding to a plurality of horizontal lines of the display panel, respectively.

In addition, the timing controller TCON may transmit image data, which corresponds to each of the horizontal lines, for each horizontal line period 1-H. As an example, each of the horizontal line periods 1-H may include a blank pattern transmission period and a line data transmission period in terms of the timing controller TCON. The timing controller TCON may include and transmit a configuration packet, which includes a scramble reset signal, in a blank pattern during the blank pattern transmission period, and may position the configuration packet in an end period of a blank pattern, that is, an end period of the blank pattern transmission period and transmit the configuration packet to the source driver SDIC.

In addition, the timing controller TCON may transmit line data including the control data packet, the image data, and the data checksum to the source driver SDIC during the line data transmission period of the horizontal line period 1-H.

In addition, in terms of the source driver SDIC, the horizontal line period 1-H may include a blank pattern reception period and a line data reception period.

The source driver SDIC may receive the configuration packet including the scramble reset signal during the blank pattern reception period, and restore the line data including the control data packet, the image data, and the data checksum by using the scramble reset signal during the line data reception period. Here, the source driver SDIC may align image data according to the data link.

In addition, the source driver SDIC may convert the image data into a corresponding data voltage in response to the control data packet, and provide the data voltage to the corresponding pixels to drive the display panel.

As described above, according to embodiments, a display panel can be stably driven by avoiding the influence of high voltage noise using protocols between a timing controller and source drivers in display panel driving.

In addition, according to embodiments, a display panel can be stably driven by stably restoring a control data packet which may be lost due to high voltage noise.

What is claimed is:

1. A display device comprising:

a timing controller configured to transmit a communication signal, which includes a blank pattern and line data, at a horizontal line interval; and a source driver configured to restore the blank pattern and the line data in the communication signal and drive a display panel using the blank pattern and the line data, wherein the timing controller includes a configuration packet in the blank pattern and positions the configuration packet in an end period of the blank pattern, and the source driver receives a source output enable signal enabled at the horizontal line interval and restores a link through clock training after the source output signal is enabled.

2. The display device of claim 1, wherein the timing controller positions the configuration packet in the end period of the blank pattern positioned farthest from line data of a previous horizontal line.

3. The display device of claim 1, wherein when a failure occurs in a link lock signal, the timing controller includes the configuration packet in the blank pattern after the link lock signal is restored.

4. The display device of claim 1, wherein the source driver provides a link lock signal indicating a lock failure to the timing controller when the lock failure occurs after the source output enable signal is enabled.

5. The display device of claim 4, wherein the source driver restores the link through at least one of clock training and link training.

6. The display device of claim 5, wherein the timing controller includes the configuration packet in the blank pattern after the link is restored.

7. The display device of claim 1, wherein the source driver restores at least one of a control data packet, image data, and a data checksum of the line data in response to a scramble reset signal of the configuration packet.

8. A display driving device comprising at least one source driver configured to restore a blank pattern and line data in a communication signal transmitted at a horizontal line interval and drive a display panel using the blank pattern and the line data, wherein a configuration packet is included in the blank pattern, and the configuration packet is set to be positioned in an end period of the blank pattern, and the source driver receives a source output enable signal enabled at the horizontal line interval and restores a link through clock training after the source output enable signal is enable.

9. The display driving device of claim 8, wherein the configuration packet is set to be positioned in the end period of the blank pattern positioned farthest from line data of a previous horizontal line.

10. The display driving device of claim 8, wherein when a failure occurs in a link lock signal, the configuration packet is set to be included in the blank pattern after the link lock signal is restored.

11. The display driving device of claim 8, wherein the source driver provides a link lock signal indicating a lock failure to a timing controller when the lock failure occurs after the source output enable signal is enabled.

12. The display driving device of claim 11, wherein the source driver restores a link through at least one of clock training and link training.

13. The display driving device of claim 12, wherein the source driver provides the link lock signal indicating that the link is restored to the timing controller, and receives the configuration packet positioned in an end period of the blank pattern.

14. The display driving device of claim 8, wherein the source driver restores at least one of a control data packet, image data, and a data checksum of the line data in response to a scramble reset signal of the configuration packet.

* * * * *